United States Patent [19]

Fernbaugh

[11] 3,985,183

[45] Oct. 12, 1976

[54] GARMENT RACK SECURITY DEVICE

[76] Inventor: Francis W. Fernbaugh, 92 S. Newland Court, Lakewood, Colo. 80226

[22] Filed: May 19, 1975

[21] Appl. No.: 578,418

[52] U.S. Cl. ..... 211/7; 70/58; 70/59; 211/8; 211/162

[51] Int. Cl.[2] ..... E05B 73/00

[58] Field of Search ..... 211/4, 5, 6, 7, 8, 9, 211/94, 162; 70/18, 58, 59, 62; 194/1 Q, 1 J, 40, 49, 64

[56] References Cited

UNITED STATES PATENTS

| | | | |
|---|---|---|---|
| 780,985 | 1/1905 | Fossum | 211/4 UX |
| 1,043,351 | 11/1912 | Paskell | 211/4 X |
| 1,618,885 | 2/1927 | Minor | 211/8 |
| 1,800,606 | 4/1931 | David | 223/92 |
| 1,888,168 | 11/1932 | Hoffman | 223/92 |
| 2,757,804 | 8/1956 | Sadwin | 211/94 |
| 2,869,903 | 1/1959 | Hewitt | 211/162 |
| 3,197,008 | 7/1965 | Moore | 211/94 X |
| 3,606,948 | 9/1971 | Strang | 211/4 |
| 3,690,130 | 9/1972 | Eutzler | 211/4 X |

FOREIGN PATENTS OR APPLICATIONS

| | | | |
|---|---|---|---|
| 31,310 | 7/1907 | Austria | 211/4 |
| 200,962 | 10/1907 | Germany | 211/4 |
| 543,080 | 1/1932 | Germany | |
| 17,631 | 9/1897 | United Kingdom | 211/8 |

*Primary Examiner*—Roy D. Frazier
*Assistant Examiner*—Thomas J. Holko
*Attorney, Agent, or Firm*—Sheridan, Ross, Fields & McIntosh

[57] ABSTRACT

A merchandise rack security device is provided which includes a plurality of elongated members depending from and slidable along a guide rail above articles of merchandise. In one embodiment, each member includes pivoted arms at the terminal end thereof which can be moved from a closed unlocked position in which they lie substantially along the axis of the elongate member and an open locked position in which they are substantially perpendicular to this axis. Each elongated member is extendable through a sleeve of an article, such as a garment hung on a hanger from a clothes rod, and by means of a control member located above the rod the arms can be simultaneously moved to the open position for each garment on the rack so that the garments cannot be removed therefrom. Similarly, the control means can be used to close the arms on the elongate members simultaneously so that any one of the garments can be removed from the garment rack. In another embodiment, the terminal end can be locked into the guide rail after the member is looped through the article to be secured.

19 Claims, 20 Drawing Figures

GARMENT RACK SECURITY DEVICE

BACKGROUND OF THE INVENTION

1. Field of the Invention

This invention relates to a merchandise security device, and more particularly to a security device for simultaneously locking a plurality of garments or other articles of merchandise on a single rack.

2. Description of the Prior Art

The theft of merchandise, such as garments, from public places is a chronic problem to which no entirely satisfactory solution has been found. A number of anti-theft devices have been devised for use in restaurants, cloak rooms, clothing stores and the like. Examples of such devices are found in U.S. Pat. No. 610,372 to Sanford; U.S. Pat. No. 1,043,351 to Paskell; U.S. Pat. No. 1,040,181 to Frank; U.S. Pat. No. 1,618,885 to Minor: U.S. Pat. No. 3,378,144 to Webster; and U.S. Pat. No. 3,606,948 to Strang. Although each of the devices illustrated in the above-mentioned patents is able to provide the desired security, there are a number of reasons why the use of these inventions generally have not met with wide acceptance.

In the first place, most such devices are unduly complicated and cumbersome and therefore the time and difficulty required in using them is too great to be acceptable. Secondly, such devices are often very costly and therefore are not justified even though the reduction of the theft of garments may result. Finally in an establishment like a clothing store it is highly inconvenient to unlock each item of merchandise whenever a customer wishes to try it on or examine it and then re-lock it after he is finished and then perhaps unlock and re-lock additional garments or other articles from the same rack for the same customer. In addition, when a number of customers and salesmen are on the floor the confusion and difficulties are compounded by this sort of apparatus. The result has been that stores for the most part have not invested in such equipment even though the theft of merchandise continues and increases at an alarmingly high rate. With smaller merchandise, such as radios and the like, it is often necessary to keep it in a locked cabinet from which it must be removed whenever a customer wishes to examine it. This procedure is troublesome and unsatisfactory to both the customer and the sales personnel.

SUMMARY OF THE INVENTION

In accordance with the present invention a merchandise rack security device for releasably securing a plurality of articles of merchandise to a rack is provided which includes a plurality of elongated members each of which has one end fixedly attached adjacent the rack and has a terminal end extending through a portion of an article of merchandise and means on the terminal end for locking it to prohibit removal of the article and means for simultaneously locking and unlocking the terminal end so that all articles on the rack are either removable or secured to prevent removal therefrom.

More specifically, one embodiment of the invention contemplates a security device which includes a generally U-shaped guide rail mounted above and generally parallel a garment rack rod and terminating in inturned flanges at the side of the rail facing the rod to form a slot for slidably receiving a plurality of elongated members. Each of these members is extendable through a sleeve of a garment and includes an outer sleeve and an inner filament, such as cable or wire, which is longitudinally movable. The terminal end is attached to a pin movable longitudinally along a slot in a housing which is attached to the terminal end of the outer sleeve. A pair of arms are pivoted to the pin and have cam means which cooperate with cam means on the housing so that upon movement of the filament into the rail the pin moves upwardly along slots in the housing which serve as guideways. The cam action between the arms and housing due to upward movement of the arms in the housing causes the arms to pivot from a closed unlocked position in which they lie generally along the axis of the cable to an extended or open locked position in which they lie substantially perpendicular thereto to prevent removal of the elongated member from the sleeve of the garment. The enlarged end of the filament is slidably held within the slot in a channel member which is smaller than the guide rail and mounted for movement toward and away from the opening in the rail through a linkage means connected to a handle pivotally mounted on the guide rail. When the channel is moved upwardly the filament will be moved with it and relative to the outer sleeve to move the pivotal arms from the closed to open position. Reverse movement of the handle will move the channel and hence the filament downwardly causing the arms to close. Thus all of the garments on the rack can either be locked or unlocked simultaneously. A visual and/or audible indicator can be mounted on the guide rail responsive to movement of the channel so that the position of the arm for securing the garments is known at all times. Such a structure is simple in construction and easy to operate and has the distinct advantage of being able to simultaneously lock a plurality of garments to a rack or to unlock them when they are being tried on by customers in the store.

In another embodiment, the member is looped through an article of merchandise to be secured and the terminal end and connected and locked to the guide rail. This terminal end is dimensioned to fit through the slot in the guide rail and then rotated 90° to secure it in position. A locking channel within the guide rail can be moved between a locked position in which the terminal end cannot be rotated and removed from the guide rail and an unlocked position which permits removal of the terminal end.

Additional advantages of the invention will become apparent from the description which follows, taken in conjunction with the accompanying drawings.

DESCRIPTION OF THE PREFERRED EMBODIMENTS

Figure 1:
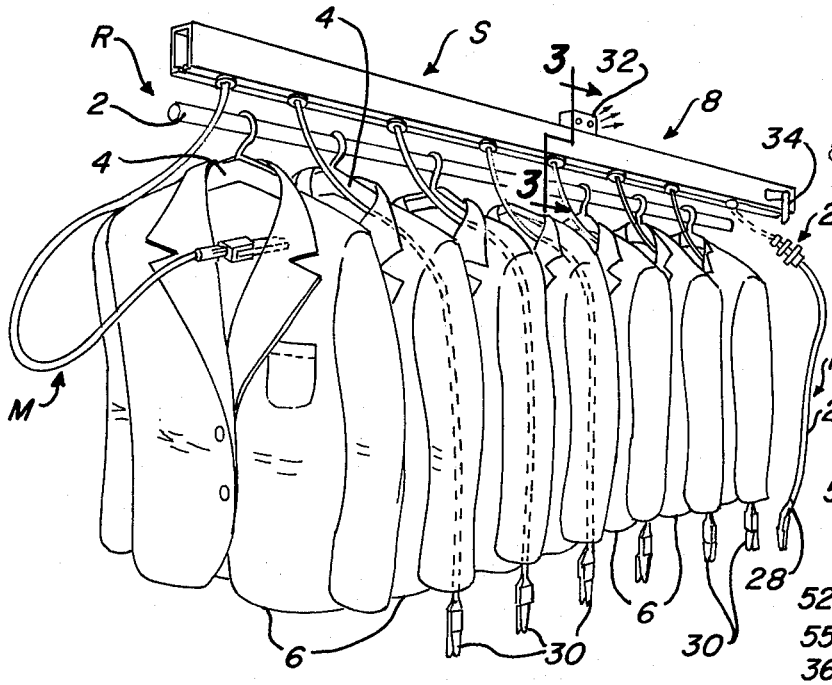
FIG. 1 is a perspective view of a merchandise security device in accordance with this invention mounted for use with an adjacent garment rack and in unlocked position.
Figure 2:
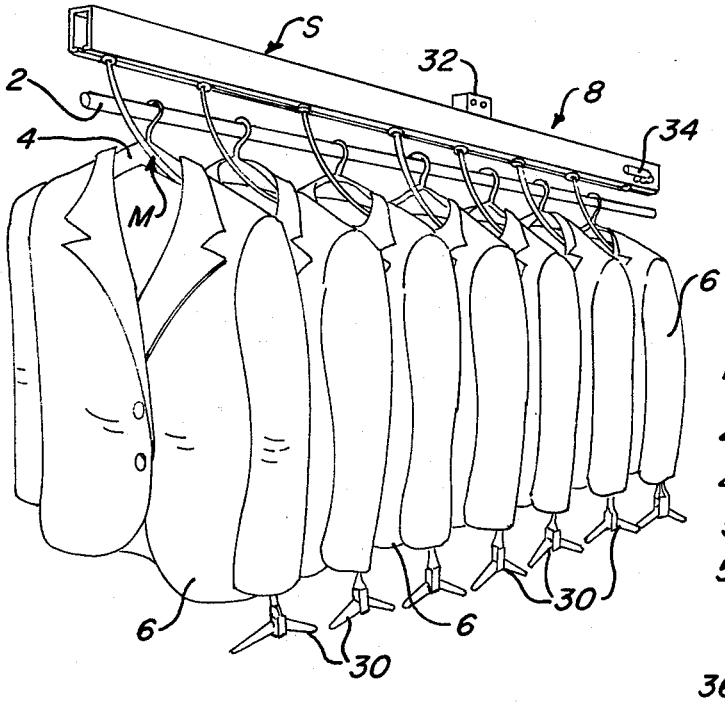
FIG. 2 is a perspective view, similar to FIG. 1, but showing the merchandise rack security device in locked position.

In accordance with this invention, a security device S is provided which is mounted above a garment rack R which includes a rod 2 for supporting a plurality of clothes hangers 4 on which garments 6 are hung as seen in FIGS. 1 and 2. Conveniently, rod 2 can be of the type which is permanently attached as a fixture in a clothing store or could be on a free standing rack in which case suitable brackets, not shown, would have to be provided for supporting the security device S above the rack. In those situations where the rod 2 is permanently mounted on the wall of a store the security device S can be mounted permanently to the wall in a similar manner.

The security device includes a longitudinal guide rail 8 which extends above and generally parallel to rod 2. This guide rail is generally U-shaped and includes a top wall 10 from which depends sidewalls 12 and 14 which terminate in inturned flanges 16 and 18 respectively which form a longitudinal slot 20 therebetween.

A plurality of elongated members M are provided with connectors 22 for releasably connecting them to guide rail 8 for slidable movement therealong as will be described more fully below. Conveniently, each elongated member M includes an outer sleeve 24 through which a filament 26, such as a wire or cable extends. The connector 22 is attached to the upper end of the sleeve 24 and a housing 28 is connected to the terminal or lower end of sleeve 24. A pair of arms 30 are mounted in housing 28 for pivotal movement from a closed unlocked position, as shown in FIG. 1, to an open locked position, as shown in FIG. 2, by movement of filament 26 within sleeve 24 as described below.

It will be apparent that when the arms are in the closed or unlocked position of FIG. 1 any one of garments 6 may be removed from their respective hangers 4 so that a prospective customer may try them on. A garment can be removed from the rack merely by sliding it off the hanger and down the elongated member so that it is removed from the sleeve. To replace the garment on the rack it can be hung back on its hanger 4 and the elongated member M can be threaded through the sleeve thereof, as shown. During this period of time a salesman or other store personnel will be present to assure that there is no unauthorized taking of the garments from the rack by the customer or by anyone else. In addition, a signal device 32 can be provided on guide rail 8 to provide a visual and/or audible signal when the security rack is in the open unlocked position. Thus, store personnel will be alerted to watch this rack during the period it is unlocked.

When the customer has finished looking at the garments on the rack, the salesman can pivot handle 34 from the unlocked position of FIG. 1 to the locked position of FIG. 2 so that arms 30 of each respective elongated member M are spread apart so garments can no longer be removed from this rack.

Figure 5:
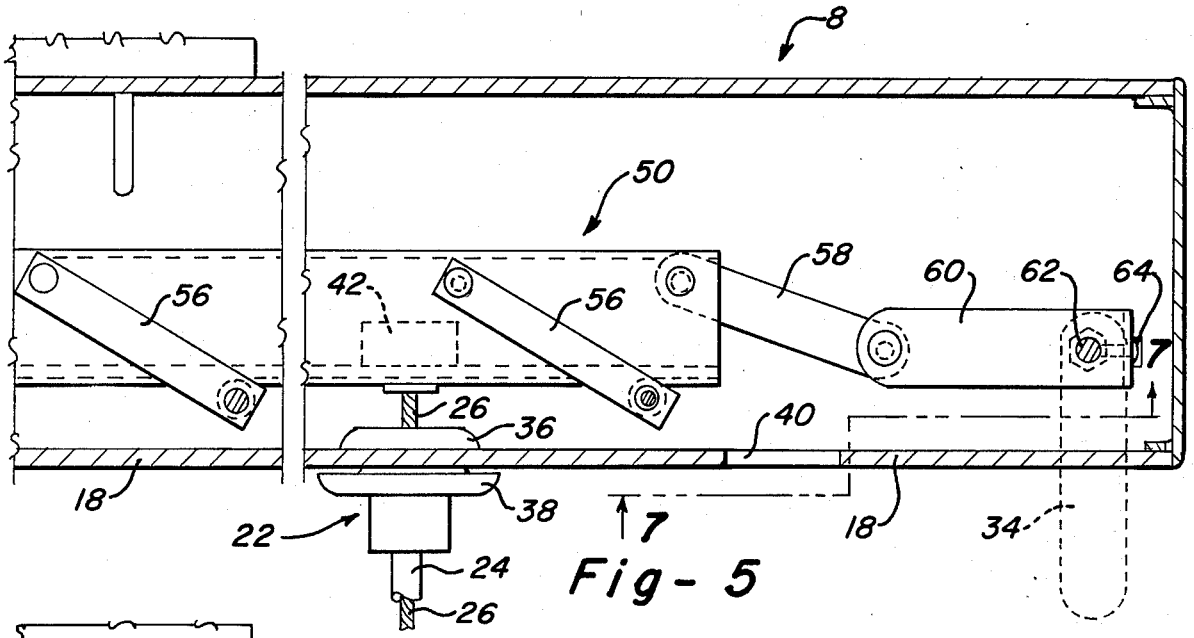
FIG. 5 is a fragmentary longitudinal section taken along line 5—5 of FIG. 3 showing the position of the control channel and other related parts when the security device is in unlocked position.
Figure 6:
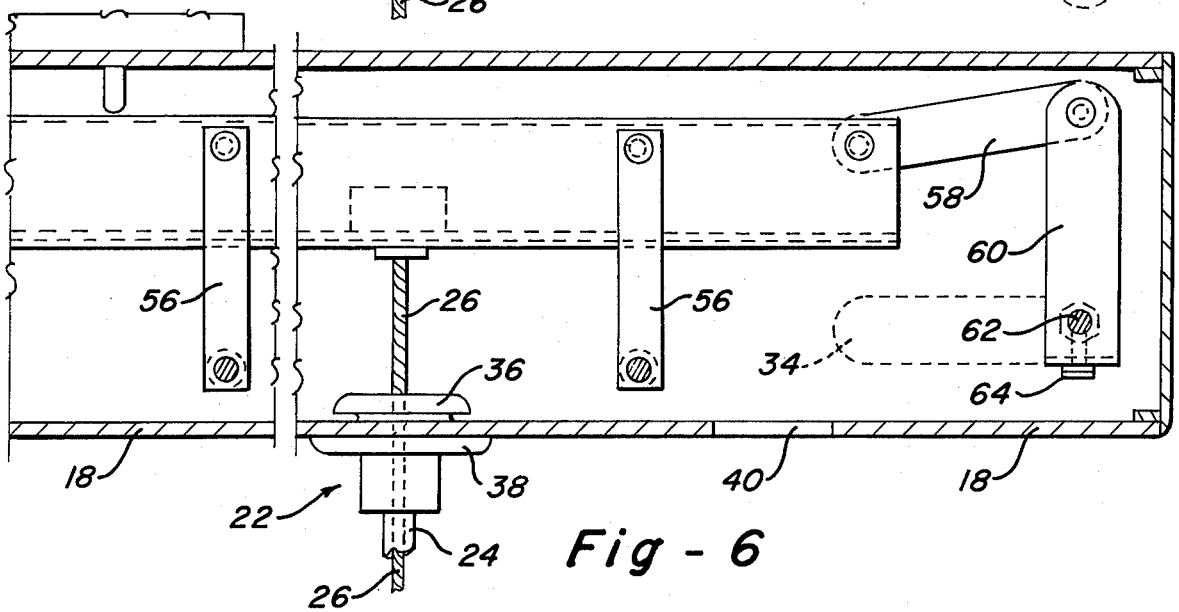
FIG. 6 is a fragmentary horizontal section, similar to FIG. 5, but showing the control channel and related parts of the security device in locked position.
Figure 7:
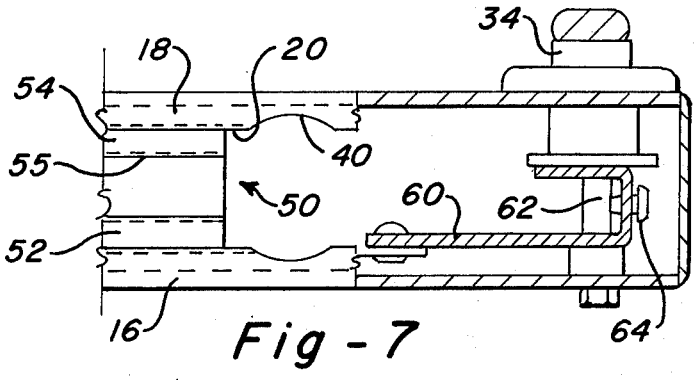
FIG. 7 is an offset section taken along line 7—7 of FIG. 5 showing an opening for inserting the elongated members on the guide rail and details of the link means connecting the handle to the channel.

Conveniently, connector 22 is in the form of a bushing having a smaller upper flange 36 and a larger lower flange 38 as seen in FIGS. 3–6. Conveniently, upper flange 36 is sized to fit through an opening 40 formed by recesses in rails 16 and 18 adjacent handle 34, as best seen in FIG. 7. However, the lower flange 38 is too large to go through this opening and therefore elongated member M will be supported by upper flange 36 of connector 22 which rides along flanges 16 and 18 as shown and can be moved to any adjusted position along guide rail 8. Thus, it can be seen that a connector can be provided for each hanger 4 on rod 2 and that the number of hangers or rods can be made greater or smaller as conditions require. For example, when a garment is sold the hanger can be removed and if desired the elongated member M can also be removed from the rail. Conversely, additional garments and elongated members can be added to the rack when new merchandise is displayed.

Figure 3:
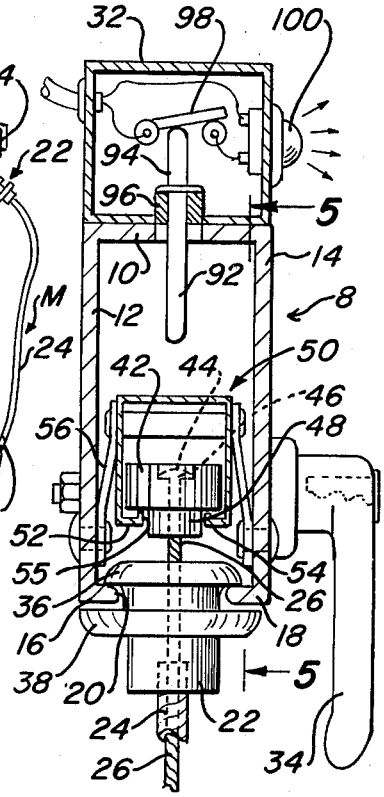
FIG. 3 is an enlarged offset vertical section taken along line 3—3 of the rack of FIG. 1 showing details of a signaling device and the locking mechanism when the security device is in unlocked position.
Figure 4:
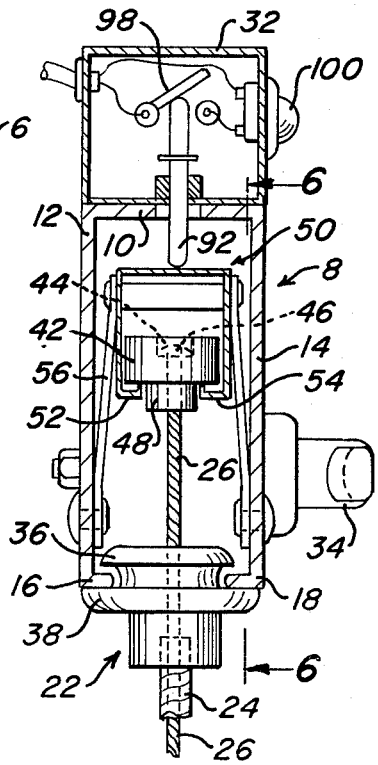
FIG. 4 is an enlarged vertical section, similar to FIG. 3 but showing the locking mechanism in locked position and the signaling device in inoperative condition.

The upper end of cable 26 extends through a central opening in a collar 42 having a recess 44, as seen in FIGS. 3 and 4, for receiving the enlarged end 46 of cable 26. The collar includes a reduced neck at the lower end thereof which serves as a spacer between the collar and upper flange 38 of connector 22.

When an elongated member M is attached to guide rail 8 by slipping flange 36 of connector 22 through opening 40, collar 42 will advantageously be aligned with the end of a movable channel 50 when the security device is in the unlocked position of FIGS. 3 and 5. Channel 50 includes inturned flanges 52 and 54 to form a slot along which collar 42 will slide as best seen in FIGs. 3 and 4. Conveniently, movable channel 50 is pivotally mounted on guide rail 8 by means of spaced parallel links 56 pivoted to the respective side walls of the channel and guide rail, as shown. Thus, when handle 34 is pivoted from the position shown in FIGs. 1, 3 and 5, i.e., the unlocked position to the locked position shown in FIGS. 2, 4 and 6, channel 50 will be swung from a position close to flanges 16 and 18 of guide rail 8, as in FIGS. 3 and 5, to a position spaced a substantial distance thereabove, as shown in FIGS. 4 and 6. Furthermore, as seen in FIG. 6, in the locked position channel 50 will be displaced to the right to extend across opening 40 to prevent removal of the elongated means when channel 50 is in the locked position. This movement is caused by a linkage connection between channel 50 and handle 34 which includes pivoted link 58 connected at one end to the channel and the other end connected to an arm 60 which is fixedly attached to shaft 62 of handle 34 and held in fixed position with respect thereto, as by screw 64. By comparing FIGS. 3 and 4 and FIGS. 5 and 6, it can be seen that when the handle 34 is rotated from the unlocked position to the locked position and channel 50 is moved upwardly away from the flanges of guide rail 8, filament 26 will be pulled upwardly with respect to sleeve 24. This action will cause arms 30 on the opposite end to be moved from the closed position to the open position as best seen by referring to FIGS. 8–13.

A housing 28 is attached to the terminal end of sleeve 24 by a tubular extension 66 having a central opening through which filament 26 extends. The housing terminates in a generally rectangular base 68 which includes a transverse opening for receiving the upper ends of arms 30 and permitting pivotal movement thereof as shown. Base 68 includes opposed walls 70 and 72 which are provided with generally vertical slots 74 and 76 respectively as shown. These slots provide a guideway for opposite ends of pin 78 which is centrally attached to the terminal end of filament 26 with the ends thereof embedded in bosses 80 of the respective arms 30 which bosses engage slots 74 and 76 and are guided therealong when filament 26 is pulled upwardly.

Figure 8:
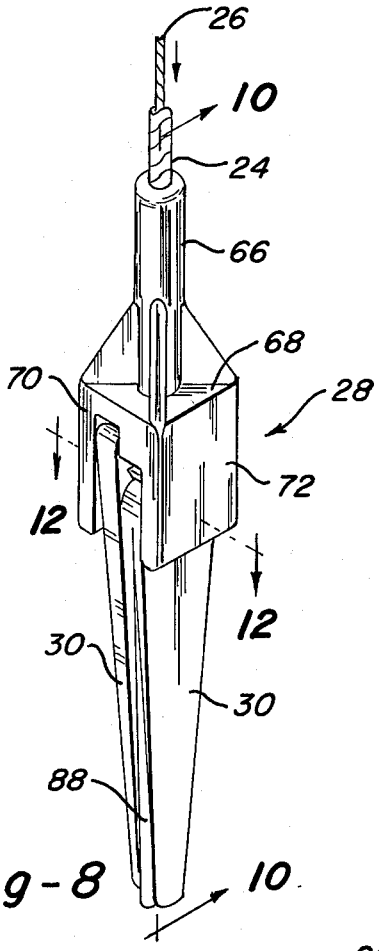
FIG. 8 is an enlarged fragmentary perspective view of the terminal end of the elongated member showing the housing and pivotal arms with the arms in closed unlocked position.
Figure 9:
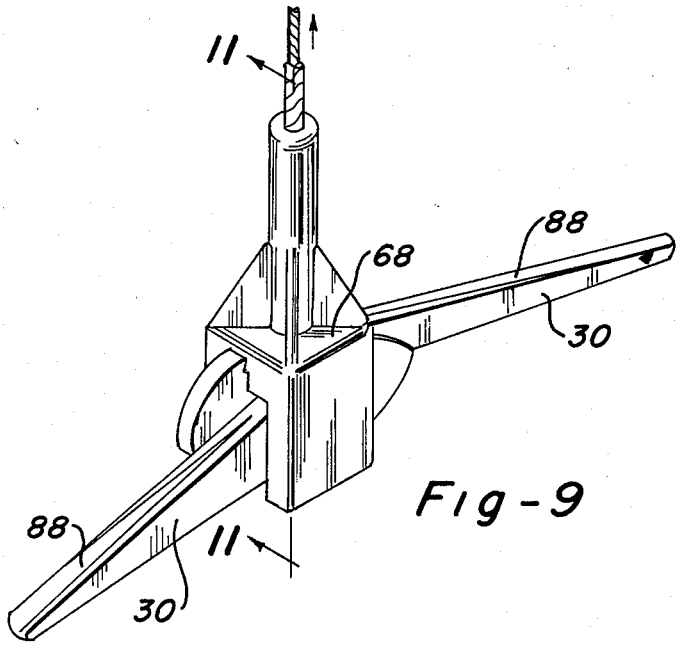
FIG. 9 is a perspective view, similar to FIG. 8, but showing the arms in open locked position.
Figure 10:
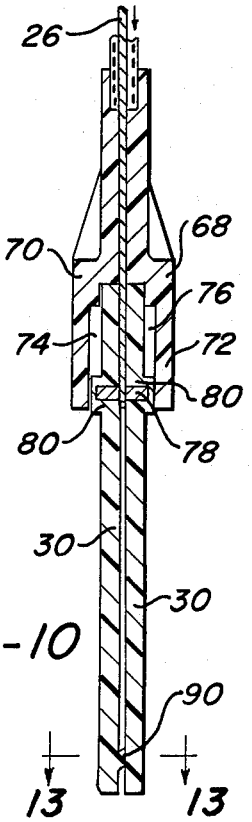
FIG. 10 is a vertical section taken along line 10—10 of FIG. 8.
Figure 11:
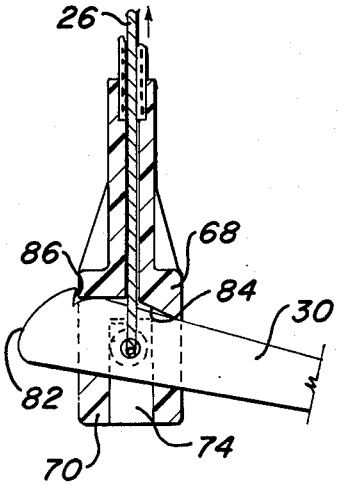
FIG. 11 is a vertical fragmentary section, taken along line 11—11 of FIG. 9 showing the cam surfaces of the pivoted arms and the interlocking relationship with the housing when the arms are in raised position.
Figure 12:
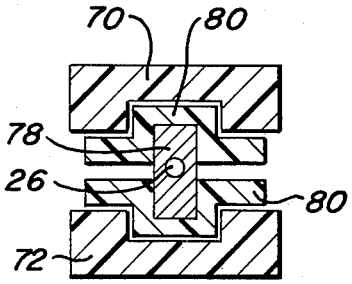
FIG. 12 is a horizontal section, taken aong line 12—12 of FIG. 8 showing the pivot pin structure.
Figure 13:
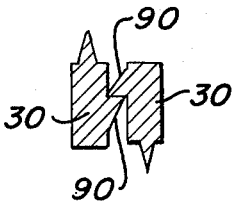
FIG. 13 is a horizontal section, taken along line 13—13 of FIG. 10 showing interlocking means for holding the arms in closed unlocked position during insertion of the elongated member through the sleeve of a garment.

Conveniently, the upper end of each arm 30 is provided with a curved cam surface 82 which is engageable with a cam surface 84 at the upper end of housing 68 so that upon movement of cable 26 in an upward direction the engagement of curve surface 82 with cam surface 84 will cause the respective arms to be pivoted outwardly from the closed position of FIG. 8 to the open position of FIG. 9. Furthermore, each arm is provided with a notch 86 adjacent the upper end thereof which engages the outer surface of the housing as shown in FIGS. 9 and 11 to prevent closure of arms 30 by pushing downwardly on them. Furthermore, the upper surfaces of each arm 30 is provided with a blade-like portion 88 which is reduced in cross section and although not sharp to the touch is capable of creating substantial discomfort to any one who attempts to forceably move arms 30 from their open to their closed position to thereby further discourage any tampering with the security device.

Another feature of the invention is the provision of interlocking tabs 90 which can be interlocked when blades 30 are in their closed position by springing them outwardly so that the tabs ride over each other to maintain the respective pairs of arms 30 in their closed position so that they are easier to thread through the sleeve of a garment. Once the arms are brought through the lower end of the sleeve they should be sprung apart so that the tabs are disengaged whereupon the arms can then be opened by manipulation of handle 34 as described above.

The security device 32 which is mounted on guide rail 8 is provided with a sensing arm 92, as seen in FIGS. 3 and 4, provided with a stop, such as flange 94, to limit its downward movement upon engagement with a bushing 96 therein when channel 50 is in its lowered position. However, when arm 92 is in the lower position, switch 98 will close to complete a circuit to light 100 to provide a visual indication that the security device is unlocked and garments can be removed therefrom. When the security device is in the locked position of FIG. 4, arm 92 will be raised by the upper surface of channel 50 which will cause switch 98 to be opened thereby breaking the circuit to light 100. It will be understood that in addition to the light or in place thereof a signal device such as a bell can be provided in the circuitry.

Figure 14:
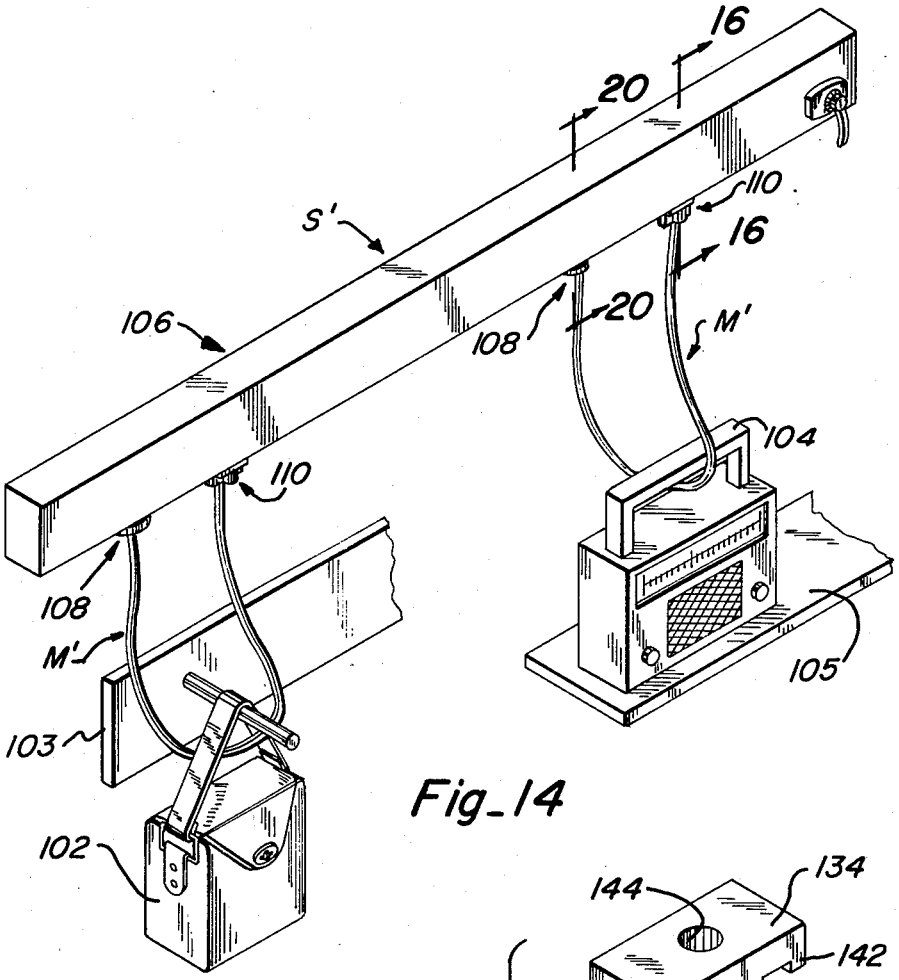
FIG. 14 is a perspective view of an alternative merchandise rack security device.

A further embodiment of the invention is disclosed in FIGS. 14–20 wherein a security device S′ is provided which is especially adapted to secure small articles, such as handbag 102 or radio 104, as shown in FIG. 14 on their respective merchandise racks 103 and 105, respectively. As in the previous embodiment, the security device includes a guide rail 106 to which a plurality of elongated members M′ are slidably attached, as shown. The guide rail is conveniently mounted on the wall or ceiling above the merchandise rack for the articles being secured. In this embodiment, both ends of elongated member M′ are connectable to guide rail 106 to form a closed loop for securing the article in place. Thus, this embodiment has application for use with merchandise which the customer does not need to remove from the rack or display area but merchandise which it is desirable for the customer to be able to handle.

Figure 15:
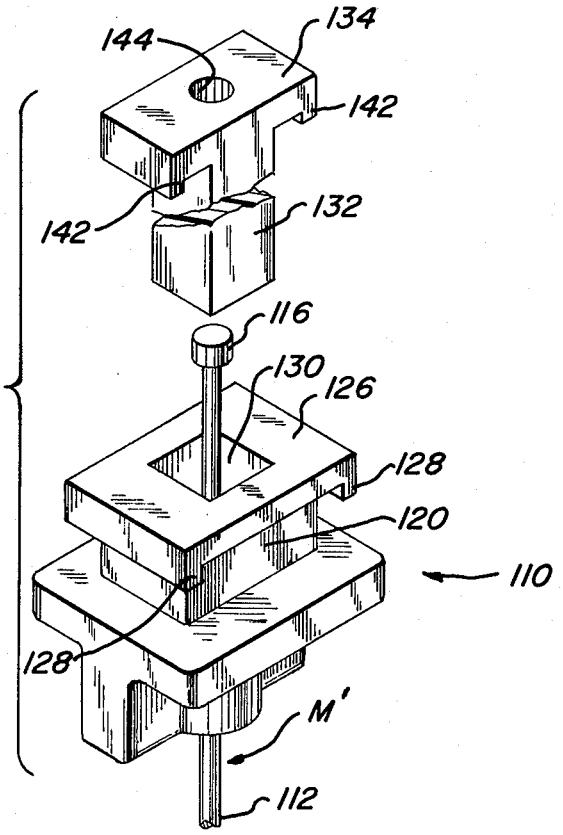
FIG. 15 is an enlarged exploded view of a removable connector for the embodiment of FIG. 14.
Figure 16:
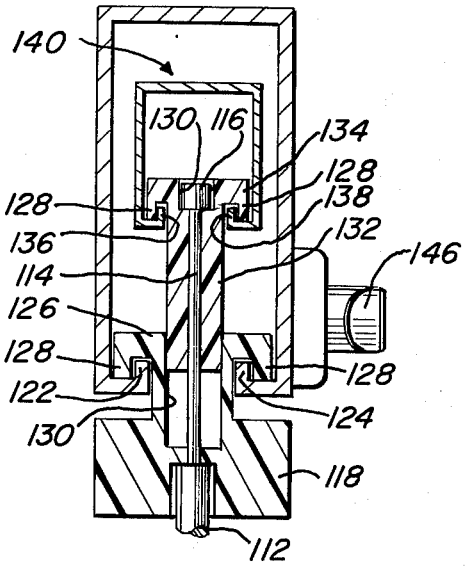
FIG. 16 is an enlarged, vertical section, taken along line 16—16 of FIG. 14 showing the connector of FIG. 15 in locked position.
Figure 17:
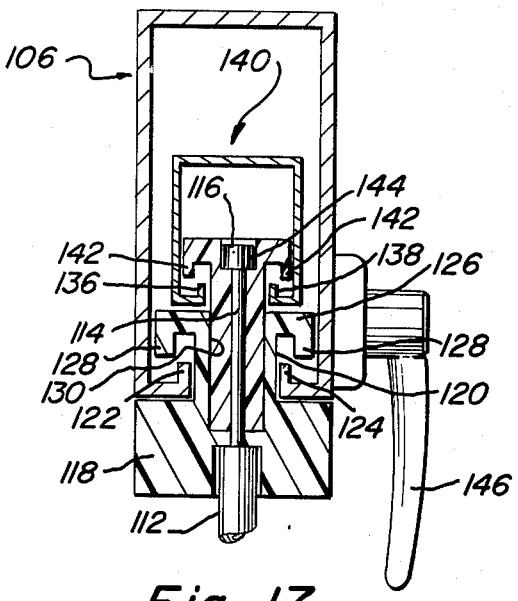
FIG. 17 is an enlarged, vertical section, similar to FIG. 16, but showing the connector in released position.

Each elongated member M′ includes a fixed collar or connector 108 and a removable collar or connector 110. One form of removable collar 110 is shown in FIGS. 15–17 and its operation can be understood by reference to those figures. Elongated member M′ includes an outer sleeve 112 and a cable or filament 114 slidable therein and provided with an enlarged end 116 as shown. The sleeve 112 is received in a recess in the bottom of bottom guide or connector 118 which includes an upper projecting neck 120 between inturned flanges 122 and 124 of guide rail 106 and terminates in a generally rectangular upper end 126 which in one dimension is of less width than the spacing between inturned flanges 122 and 124 so that it can be inserted upwardly therebetween. It is of greater dimension in the other direction and has downturned flanges 128 on either side thereof so that after insertion between flanges 122 and 124 it can be turned 90° in either direction so as to be positioned as shown in FIGS. 16 and 17. End 126 is provided with an enlarged rectangular opening 130 for receiving the lower end 132 of upper guide or connector 134 which is of a small dimension in one direction so as to be insertable through the spacing between upturned flanges 122 and 124 and also between inturned flanges 136 and 138 of locking channel 140. After insertion in the locking channel it will rotate with the rotation of lower guide 118 so that the downwardly extending flanges 142 thereon will lock behind upturned flanges 136 and 138 of locking channel 140.

Conveniently, upper guide 134 is provided with a central bore through which cable 114 extends so that enlarged upper end 116 is held in an upper recess 144 thereof, as shown.

From the foregoing, it can be seen that when handle 146 is in the unlocked position as shown in FIG. 17, so that locking rail 144 is in the lowermost position, a sales person can push upwardly on lower guide 118 so that the flanges 128 thereof are spaced from guide rail flanges 122 and 124, as shown, and the flanges of 142 of upper guide 134 are spaced from locking channel flanges 136 and 138. Whereupon, a 90° rotation of the bottom guide will cause the upper guide to rotate therewith and the removable collar or guide 110 can be separated from guide channel 106 so that the merchandise can be removed from display for sale to the customer.

Similarly, when the security device has been attached to a new article the removable collar can be inserted into the guide rail when held so that the narrow portion will fit between the respective flanges and then turned 90° to position the flanges of the guide over the flanges of the guide rail and locking channel, whereupon handle 146 may be moved to the locked position of FIG. 16 so that locking channel 140 is in the raised position. It will be understood that the interconnection between the handle and locking channel will be similar to that construction shown in FIGS. 5 and 6. When in this locked position, upper guide 134 will be raised partially out of rectangular opening 130 and filament 114 will be placed under tension so that removable collar 110 cannot be rotated because of the interlocking feature between the respective flanges, previously described.

Figure 18:
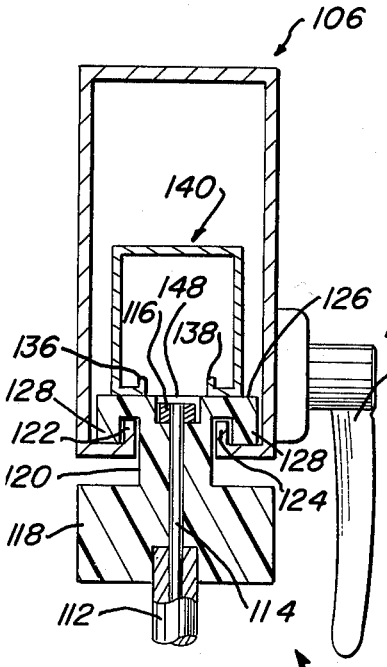
FIG. 18 is a vertical section, similar to FIG. 16, but showing an alternative removable connector in locked position.
Figure 19:
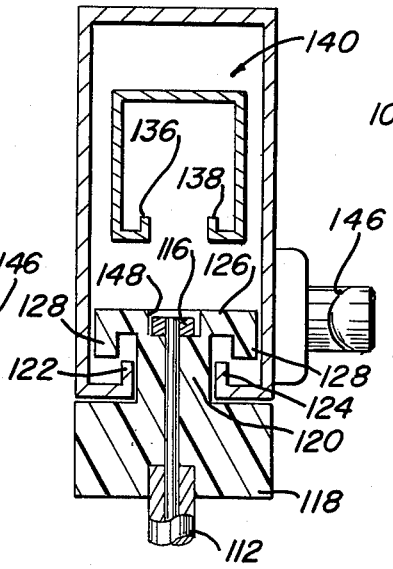
FIG. 19 is a vertical section, showing the connector of FIG. 18, in released position.

An alternative embodiment of the removable collar is shown in FIGS. 18 and 19 wherein a removable collar 110' is provided which requires only the lower guide 118 which includes a neck 120 extending between inturned flanges 122 and 124 of guide rail 106. Neck 120 terminates in an upper end 126 having a rectangular shape with depending flanges 128 at opposite sides thereof adapted to engage flanges 122 and 124 of guide rail 106. In this embodiment, rather than having an upper guide, handle 146 is connected to locking channel 140 in such a way as to move it down into engagement with the upper surface of upper end 126 of guide 118 which holds it in locked position so that it cannot be raised to be turned 90° and withdrawn. However, when handle 146 is moved to the other position wherein channel 140 is raised, as shown in FIG. 19, then guide 118 may be raised upwardly and turned 90° so as to free flanges 128 from flanges 122 and 124 so that the guide may be withdrawn. As can be seen, guide 118 will be provided with a recess 148 for receiving the enlarged upper end 116 of cable 114.

Figure 20:
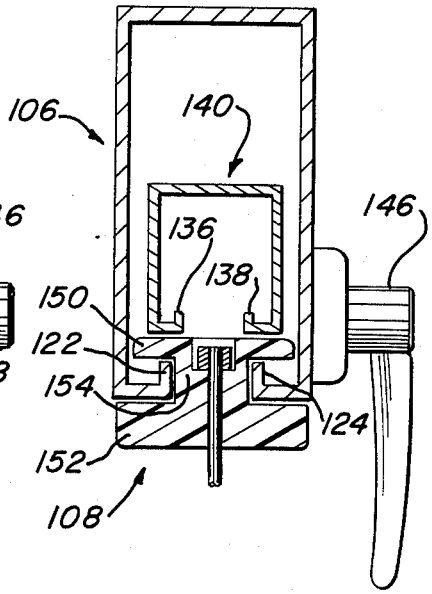
FIG. 20 is an enlarged vertical section, taken along line 20—20 of FIG. 14 showing details of the fixed connector thereof.

The fixed collar 108 is best seen in FIG. 20 which is generally in the form of a grommet having an upper flange 150 and a lower flange 152 interconnected by a neck 154 which is sized to fit between flanges 122 and 124, as shown. The fixed collar can only be removed through an opening, such as opening 40 of FIGS. 5 and 6. Of course, the fixed collar 108 can be slid back and forth along guide rail 106 as desired.

From the foregoing, the advantages of this invention should be readily apparent. A merchandise rack security device has been provided whereby a plurality of articles of merchandise can be locked or unlocked on a rack simultaneously by operation of a single control means. In one embodiment, a guide rail is provided above and generally parallel to a garment rack and has a plurality of elongated members slidably spaced therealong which can be threaded through the arm of the respective garments on the rack when the arms on the lower end of the elongated members are in closed unlocked position. When all of the elongated members have been inserted through the sleeves of the respective garments a single control handle on the guide rail can be manipulated to open all of the arms at once to lock all garments in place. Thus, when a customer wishes to try on a garment the salesman or other store personnel can move the handle from the locked to the unlocked position to permit one or more of the elongated members to be removed from the respective garments while the customer tries the garments on. After the customer has finished looking at the merchandise, the garments can be placed back on the rack and the elongated members re-inserted in the sleeves thereof whereupon the handle can be returned to the locked position so that the arms are spread apart and the garments can no longer be removed from the garment rack. Thus, the possibility of theft of garments is greatly reduced while the inconvenience of maintaining the garments in a secure condition is minimized.

In another embodiment, a guide rail is provided above a rack or other support for small articles, such as handbags or radios. The rack has a plurality of elongated members slidably spaced therealong which can be threaded through a strap or handle on the article to be secured and the terminal end of the elongated member can be removably locked in the guide rail to form a closed loop to prevent theft of the article attached thereto. The removable collar can be slipped into position through the guide rail and then rotated 90° to a fixed position whereupon it can be locked in this position by a locking channel which is manipulated by a single control handle which will lock each of the plurality of elongated members in position. Thus, a customer can examine the merchandise and handle it without the necessity of a sales person being right there since there is no danger of theft. This is advantageous to both the customer and the store since the store need not maintain such merchandise under lock and key and the customer need not ask that it be unlocked in order for him to look at it.

This invention has been described in detail with particular reference to preferred embodiments thereof, but it will be understood that variations and modifications can be effected within the spirit and scope of this invention.

What is claimed is:

1. A merchandise rack security device for releasably securing a plurality of articles of merchandise to a merchandise rack, said device comprising:

a plurality of elongated members, each of which has one end attached adjacent the rack and has a terminal end extendable through a portion of an article of merchandise;

means fixedly attached to said terminal end movable between a first position for insertion of said elongated member through the article and a second position which prohibits removal of the article from said elongated member; and means for simultaneously positioning said movable means so that all of the articles are either removable from the merchandise rack or are locked to prevent removal from the merchandise rack.

2. A merchandise rack security device, as claimed in Claim 1, wherein:

a portion of said positioning means extends longitudinally within said elongate members and each of said positioning means are operated simultaneously.

3. A merchandise rack security device for releasably securing a plurality of garments to a merchandise rack, said device comprising:

a plurality of elongated members, each having a longitudinal axis, each of which has one end attached adjacent the rack and has a terminal end extendable through a portion of a garment;

means fixedly attached to said terminal end movable between a closed position lying generally along the axis of said elongate means for insertion of said elongated member through the garment and an open position generally perpendicular to the axis of said elongated means which prohibits removal of the garment from said elongated member; and means for simultaneously opening and closing said movable means so that all garments on the rack are either unlocked for removal from the rack or are locked to prevent removal from the rack.

4. A merchandise rack security device, as claimed in Claim 3, wherein:

a portion of said opening and closing means extends through said elongate members and each of said opening and closing means are operated simultaneously from said fixedly attached end.

5. A merchandise rack security device, as claimed in Claim 4, wherein said opening and closing means includes:

a filament extending through said elongated means and having a longitudinal axis; and said movable means includes:

at least one pivotal arm connected to said filament and movable from an unlocked position lying generally along the filament axis and a locked position generally perpendicular to the filament axis.

6. A merchandise rack security device for releasably securing a plurality of garments to a merchandise rack, said device comprising:

a guide rail mountable above and generally parallel to the rack;

a plurality of elongated means releasably attached by a first end and spaced along said rail, said elongated means including an outer sleeve having a longitudinal axis and an inner filament movable longitudinally with respect to said outer sleeve along said axis;

a pair of pivotal arms on the terminal end of said filament movable between open locked position and closed unlocked position by movement of said filament relative to said sleeve; and means connected to said first end of said elongated means to move said filament longitudinally within said outer sleeve to pivot said arms between said open locked position and said closed unlocked position.

7. A merchandise rack security device, as claimed in claim 6, further including:

a housing attached to said terminal end of said outer sleeve and having opposed slots in opposite side walls of said housing, said slots running generally parallel to said axis of said filament;

a pin attached to said terminal end of said filament, said arms being pivoted on said pin and said pin being longitudinally movable along said slots as guideways; and cooperating cam means between said pivotal arms and said housing to pivot said arms outwardly upon longitudinal movement of said pin and arms along said guideway toward said outer sleeve due to movement of said filament relative to said sleeve.

8. A merchandise rack security device, as claimed in claim 6, further including releasable interengaging lock means on said arms for holding said arms in closed position when inserting said elongated means and said arms through a garment.

9. A merchandise rack security device, as claimed in claim 6, wherein:

said arms include sharpened edges along the upper portion of said arms when said arms are in said open locked position to discourage forcible closure of said arms.

10. A merchandise rack security device, as claimed in claim 6, wherein said rail is U-shaped with inturned flanges along the open side thereof to form a first longitudinal slot, said rail being mountable with said first slot downward, said elongated means further including:

a bushing attached to said first end of said sleeve and engageable with and slidable along said first slot for selectively positioning said elongated means with respect to said rack.

11. A merchandise rack security device, as claimed in claim 10, further including:

channel means smaller than said rail and mounted within said rail, said channel means having inturned flanges forming a second longitudinal slot facing said first slot and being movable from an unlocked position adjacent said first slot to a locked position spaced therefrom for moving said filament relative to said sleeve to pivot said arm to open position when said channel means is in locked position and to closed position when said channel is in unlocked position.

12. A merchandise rack security device, as claimed in claim 11, further including:

a handle pivotally mounted at one end of said guide rail;

a plurality of longitudinally spaced link means pivotally attaching said channel means within said rail for movement between said locked position and said unlocked position.

13. A merchandise rack security device, as claimed in claim 10, wherein said rail further includes:

a notch adjacent one end of said first slot for receiving the upper end of said bushing for bringing it into sliding engagement with said first slot for movement along said guide rail.

14. A merchandise rack security device for releasably securing a plurality of garments to the merchandise rack, said device comprising:

a U-shaped guide rail extendable longitudinally adjacent a garment rod and having inturned flanges at the bottom end thereof spaced apart to form a first longitudinal slot, said slot having an enlarged opening adjacent one end thereof;

a channel of smaller size than said guide rail and extending longitudinally therein within said guide rail, said channel having inturned flanges forming a second longitudinal slot facing said first longitudinal slot movable between a locked position adjacent said first slot and a locked position spaced therefrom;

a handle pivotally mounted on said guide rail for moving said channel between said unlocked and locked positions;

a plurality of elongated means, each means having a longitudinal axis and including an outer sleeve and an inner filament longitudinally movable with respect to said sleeve and having a bushing connected at one end to said sleeve, said bushing being receivable through said opening so as to be slidable along said first slot in said guide rail and an enlarged end on said filament adjacent said bushing said enlarged end being receivable in said second slot of said movable channel;

a housing at the terminal end of said elongated means having side walls with opposed vertical slots forming guideways extending generally parallel to the longitudinal axis of said elongated means;

pivotal arms connected to a pin slidable in said slot, said pin being attached to said filament and movable upwardly in said slot upon pivotal movement of said handle to move said channel from said unlocked position to said locked position; and cam means between said pivotal arms and said housing to cause said arms to pivot outwardly upon said upward movement of said pin in said slots.

15. A merchandise rack security device, as claimed in claim 14, said arms further including:

an ear on each arm adjacent the pivotal end thereof for engagement with said housing when said arms are in open position to prevent forcible closure of said arms when said channel is in said locked position.

16. A merchandise rack security device, as claimed in claim 14, wherein:

said engagement on said filament is a collar having a peripheral flange engageable with said second slot and movable therealong.

17. A merchandise rack security device, as claimed in claim 14, wherein said arms include:

sharpened upper edges to discourage forcible closure of said pivoted arms by a downwardly exerted force on said arms.

18. A merchandise rack security device, as claimed in claim 16, further including:

a parallel linkage interconnecting said guide rail and said channel for swinging pivotal movement of said channel from an unlocked position adjacent said first slot with an end of said channel adjacent said enlarged opening for receiving said collar on said second flange to a locked position spaced therefrom and extending across said enlarged opening to prevent removal of said elongated means from said guide rail when said channel is in locked position.

19. A merchandise rack security device, as claimed in claim 14, further including:

signal means operated by movement of said handle between locked and unlocked position.

* * * * *